US010925408B2

(12) United States Patent
Nam

(10) Patent No.: US 10,925,408 B2
(45) Date of Patent: Feb. 23, 2021

(54) PORTABLE BODY SUPPORT COMPRISING MASK AND SADDLE

(71) Applicant: Ki Yeal Nam, Seongnam (KR)

(72) Inventor: Ki Yeal Nam, Seongnam (KR)

( * ) Notice: Subject to any disclaimer, the term of this patent is extended or adjusted under 35 U.S.C. 154(b) by 264 days.

(21) Appl. No.: 15/772,071

(22) PCT Filed: Oct. 26, 2016

(86) PCT No.: PCT/KR2016/012041
§ 371 (c)(1),
(2) Date: Apr. 29, 2018

(87) PCT Pub. No.: WO2017/073994
PCT Pub. Date: May 4, 2017

(65) Prior Publication Data

US 2018/0317663 A1 Nov. 8, 2018

(30) Foreign Application Priority Data

Oct. 28, 2015 (KR) ..... 10-2015-0149910

(51) Int. Cl.
*A47C 17/64* (2006.01)
*A61G 13/12* (2006.01)
(Continued)

(52) U.S. Cl.
CPC ..... *A47C 17/64* (2013.01); *A47C 16/00* (2013.01); *A47C 19/12* (2013.01); *A47C 20/02* (2013.01);
(Continued)

(58) Field of Classification Search
CPC ..... A47C 17/64; A47C 16/00; A47C 20/026; A47C 19/12; A47C 20/02; A61G 7/07;
(Continued)

(56) References Cited

U.S. PATENT DOCUMENTS 1,195,917 A * 8/1916 Dawes ..... A47C 16/00 5/657
2,823,393 A * 2/1958 Baldine ..... F41H 7/00 5/652
(Continued)

FOREIGN PATENT DOCUMENTS

JP 3065962 U 2/2000
JP 2000-079143 A 3/2000
(Continued)

*Primary Examiner* — Myles A Throop
(74) *Attorney, Agent, or Firm* — Maschoff Brennan

(57) ABSTRACT

The present invention relates to a portable body support and, more particularly, a body support providing functions of preventing the body from sliding down from an inclined support and also completely relieving load on the neck supporting the head at a face support part of the body support when the body support, such as a folding table or a portable temporary bed, is obliquely set up on the floor and used in a prone position so as to be useable for activities such as reading, thereby ensuring an effect of providing a technical configuration for not generating neck pain at all. As to the technical configuration, provided is the portable body support for coupling a face support mask and a pelvis support saddle to each other by using hinges, bolts and the like and constructing the coupled mask and saddle. When reading for a long time in a prone state by using the portable body support, comprising the mask and the saddle, of the present invention, neck pain, whole body fatigue, and the like are not generated at all, and an advantage of maintaining, for a long time, mental strength and posture to concentrate conveniently on reading in a prone state is guaranteed.

1 Claim, 10 Drawing Sheets

(51) Int. Cl.

| | |
|---|---|
| ***A61G 7/07*** | (2006.01) |
| ***A47C 20/02*** | (2006.01) |
| ***A47C 16/00*** | (2006.01) |
| ***A47C 19/12*** | (2006.01) |
| ***A61G 15/00*** | (2006.01) |

(52) U.S. Cl.
CPC ..... *A47C 20/026* (2013.01); *A61G 7/07* (2013.01); *A61G 13/121* (2013.01); *A61G 13/122* (2013.01); *A61G 13/123* (2013.01); *A61G 13/129* (2013.01); *A61G 15/007* (2013.01)

(58) Field of Classification Search
CPC .. A61G 13/123; A61G 13/121; A61G 13/122; A61G 13/129; A61G 15/007
See application file for complete search history.

(56) References Cited

U.S. PATENT DOCUMENTS 2,839,766 A * 6/1958 Hull ..... A47C 16/00 5/632
2,962,086 A * 11/1960 Waltimyer ..... A47C 20/026 297/392
3,423,773 A * 1/1969 Yamate ..... A61G 5/1091 5/610
3,431,020 A * 3/1969 Tyndall ..... A61G 5/1091 297/467
3,733,104 A * 5/1973 Carstensen ..... A47D 13/08 297/377
3,754,787 A * 8/1973 Garber ..... A47C 9/025 297/195.11
3,828,377 A * 8/1974 Fary, Sr. ..... A47C 20/026 5/632
3,839,755 A * 10/1974 Iannucci ..... A61G 5/00 5/83.1
3,897,102 A * 7/1975 Lemaire ..... A47C 1/143 5/656
4,207,879 A * 6/1980 Safadago ..... A61G 13/009 482/142
4,354,485 A * 10/1982 Safadago ..... A61G 13/009 606/242
4,441,221 A * 4/1984 Enste ..... A61G 5/1091 5/657
4,647,040 A * 3/1987 Ehrenfried ..... A61H 1/02 482/131
4,941,222 A * 7/1990 Prager ..... A47C 1/143 297/900
5,127,422 A * 7/1992 Colon ..... A47D 13/08 128/870
5,222,779 A * 6/1993 Johnson ..... A47C 1/143 297/283.3
5,401,078 A * 3/1995 Riach ..... A47C 7/503 297/19
5,678,894 A * 10/1997 Eley ..... A61G 15/02 297/354.13
5,720,517 A * 2/1998 Prothro, Sr. ..... A47C 7/503 297/19
5,829,080 A * 11/1998 Robillard ..... A47C 1/143 5/638
5,946,749 A * 9/1999 Sewell ..... A47C 1/143 297/188.08
6,213,555 B1 * 4/2001 Sulpizio ..... A47C 1/143 108/116
6,588,034 B2 * 7/2003 Nation ..... A47C 1/143 5/110
6,938,287 B1 * 9/2005 Mahshie ..... A47C 17/66 297/900
7,716,764 B2 * 5/2010 Joe ..... A47D 13/08 5/603
7,959,222 B1 * 6/2011 Powell ..... A47C 1/143 297/188.06
8,028,361 B2 * 10/2011 Ramer ..... A47D 13/08 128/845
D657,169 S * 4/2012 Pratt ..... D6/716.5
8,668,268 B1 * 3/2014 Cormack ..... A47C 1/026 297/354.13
8,708,406 B1 * 4/2014 Powell ..... A47C 21/00 297/188.06
2012/0012431 A1 * 1/2012 Hamilton ..... A45C 13/262 190/18 A
2017/0188715 A1 * 7/2017 Hill ..... B60N 2/882

FOREIGN PATENT DOCUMENTS

| | | | |
|---|---|---|---|
| JP | 2007-125087 | A | 5/2007 |
| KR | 1986-0001597 | Y1 | 7/1986 |
| KR | 1997-0050809 | Y1 | 9/1997 |
| KR | 10-0687186 | B1 | 2/2007 |
| KR | 10-2010-0000505 | A | 1/2010 |
| KR | 20-0476878 | Y1 | 4/2015 |

* cited by examiner

PORTABLE BODY SUPPORT COMPRISING MASK AND SADDLE

TECHNICAL FIELD

The present invention relates to a portable body support and, more particularly, to a body support providing stable reading functions as well as comfortable restfulness to back muscles, in order to prevent pain or discomfort in the face, neck, chest, shoulders, waist and pelvis when reading for a long time in a prone state on a body support such as a foldable table or a portable temporary bed obliquely set up on the floor.

BACKGROUND ART

It is a common practice that a person has a seat on a chair at a desk or on a floor and lowers his (her) head a bit when reading books. However, this posture applies tension to muscles surrounding spinal joints, in order to continuously maintain the center of the body in a straight state while supporting the skull with 24 spinal joints to prop up the body.

In particular, stress at the muscles around the cervical spine supporting the heavy head that occupies about 20% of whole body weight is increased when lowering the head, which in turn, induces a cervical disc problem and causes spinal deformity and chronic fatigue of, in particular, youths. Further, it is very difficult for youths with weak constitution who have medical problems or involve abnormal conditions in the neck and/or waist to sit and read books. Further, if reading for a long time, even a normal person with a healthy body may feel pain in the spine and may suffer from neck pain, back pain, and general fatigue. Naturally, the reader may repeatedly and habitably lie on his (her) face on the floor in order to assume a more comfortable posture. However, when reading in such a posture of lying face down (that is, in a prone position), pain and fatigue applied to the elbows and shoulder joints supporting the upper body, as well as neck muscles supporting the head, are increased.

As a result, there are always problems of preventing comfortable reading and leading to a sleeping posture to lie on their back on the floor while giving up on reading. For these reasons, in regard to conventional body support and upper body support for reading in a prone position wherein a person lies on his (her) abdomen and chest on the floor, some applications such as the prior documents below have been filed. However, the existing body support, upper support and head support for reading in a prone position have entailed the following significant problems and a drawback of impractical configuration.

More particularly, existing human body supports do not include any functional structure of suitably controlling the support to suit heights and body types of users with different physiques regardless of age and gender. Further, the head support has a construction wherein the heavy head occupying about 20% of whole body weight is fixed only by the chin, and therefore, encounters problems of lack of inventive step and convenience, leaving novelty aside.

More particularly, the chin of the human body is a skeletal part formed of free joint structures with functions of talking, swallowing saliva and helping tongue motions, and therefore, a reading manner used to read books while standing up and fixing the heavy head only using a lower part of the chin having such a soft structure has a drawback of applying too much load to the mandibular joint and also involves tension and stress of neck muscles to maintain the center of gravity, which in turn, directly leads to increase in pain. As a result, the existing body support, upper body support and head support for reading in a prone position could not be continuously used for a long time, thus causing inconvenience. The major cause of such inconvenience is very simple and clear. That is, most existing supports have limited constructions and functions for standing the chin upright on the support, in particular, stand the head upright while resting the chin on the support at an angle of about 90° to the ground. Accordingly, even when a seat part of the support contacting the chin is formed using a very soft material, this structure has a disadvantage of pressing and fixing the chin, which is a joint structure with free motion in view of a physical structure of the body, thus inhibiting free talking. That is, 'binding' effects are continued for a long time and apply a load to the mandibular joint which, in turn, causes discomfort.

Therefore, since the purpose and merit for seeking convenience in order to reduce discomfort were not continued any more but lost, the existing support was not employed in practical use. Further, the existing body support and upper body support for reading in a prone position occupy a predetermined volume and, when not in use, cause inconvenience in storage and have poor portability. For this reason, when shifting the support to another place for use, it is inconvenient to carry the support by any common method.

Alternatively, in case of a body support for body massage with typical portable functionality, which is fabricated in a slightly different form, a face seating part has a circular form so that the user can relax and rest only in a prone state. Therefore, like a scrubbing bed in a public bath, the face seating part of the above support is simply configured in a circular form. However, in such a portable temporary bed as described above, only the eyes, nose and mouth are free but the edges of the entire face of a user, except for the above parts, closely and directly contact the face seating part of the bed. Accordingly, since the support for body massage with a simple construction is secured without any particular functions such as size control to match with the face of a user and structural modification in order to comfortably support the face of the user, all edges of the entire face are kept in tightly contacting and pressing states for a long time, causing considerable discomfort to the entire face. However, tension on the neck and spine is relatively reduced, which in turn, is effective in directly inducing a sleeping state. As a result, the above support has been used not for reading but for resting or relaxing.

In other words, the pressure-functional construction of the face seating part in the conventional portable temporary bed may directly and quickly induce restful sleep in spite of discomfort at the chin, both ears and the forehead in the tightly contacting and pressing states. Therefore, the conventional temporary bed as described has usually entailed a disadvantage in that it could not be used as a tool for actions requiring a clear mind such as reading.

PRIOR ART DOCUMENT

Patent Document (Patent Document 1) Korean Utility Model Registration No. 2000321180000 (Oct. 30, 1986)

(Patent Document 2) Korean Utility Model Registration No. 2001400330000 (Dec. 17, 1998)

(Patent Document 3) Korean Patent Registration No. 10-0687186 (Feb. 20, 2007)

DISCLOSURE

Technical Problem

The present invention has been developed to solve the problems mentioned above. Therefore, an object of the present invention is to provide a portable body support, which includes, in a first aspect, a saddle with a height adjusting function (based on a sitting height) so that the body support can be controlled to suit a height of any user who has different heights and body types regardless of age and gender and, in a second aspect, which has a technical configuration of suitably selecting a face support mask to match with a face shape of the user and coupling the same to the body support. That is, in order to provide a coupling configuration for a face mask, which is a face support, without any problem in securing eyesight for reading on the body support, the face mask functioning as a contact part to protect the face while enduring a head weight, simultaneously, is coupled to a face seating part of the body support so that the heavy head is not supported by the relatively weak mandibular joint and, instead, the head weight may mostly be supported by the facial skeleton in the front part of the face, that is, the forehead of the frontal bone and the cheekbones (a pair of cheekbones protruded between both cheeks and the temples). As a result, there is provided a structural function such that the head weight of the user, that is, the face is positioned at an angle almost horizontally close to the ground, and therefore, the center of gravity of the head is not present on the lower part of the chin but is concentrated on the forehead or the middle of the forehead as well as the cheekbones, or otherwise, is dispersed toward the front part of the chin, thereby enabling comfortable reading in a prone position. Further, the body support of the present invention includes a structural characteristic of providing a reading function while freely moving the chin and talking.

In a third aspect of the preset invention, in order to conveniently store and carry the body support for reading, a leg structure on the bottom of the body support and a pelvis support (that is, a saddle) structure on the top of the body support are configured to be foldable and unfoldable at an angle of 90° by hinges. In other words, when the body support is used to read a book in a prone position, the body of a user from the head to the knees including the pelvis may be continuously and comfortably placed on the body support to thus completely relieve (100% relax) tension in muscles around the spinal joint consisting of 24 joints from the skull to the pelvis. Further, the present invention includes a functional configuration of keeping the body of a user in a rest state with no contraction of muscles, as though the user were comfortably laying on his (her) face in a prone position on a massage bed. On the other hand, the present invention provides a body support with a technical configuration that enables opening and reading of the book in front of the body support while maintaining the eyesight and the mental state of the user, thereby achieving improved comfort.

Technical Solution

In order to accomplish the above objects, a technical concept of the present invention is to provide a body support, including a main body as a support member of the body support that has a rigid and flat rectangular plane structure like a surfboard in order to sufficiently support the body of any user from the head to the knees including the pelvis regardless of age and gender, wherein two protrusions are provided at the front of the body support by which a mask can be coupled to support the face, and have a shape resembling the claws of an earwig.

The body support of the present invention may further include supporting legs to establish a reading space at a predetermined distance (30 cm or more) from the floor, wherein: the leg supporting the body support at a front part of the bottom side is far longer than the other leg supporting the body support at a rear part of the bottom side so that the body support has an oblique construction rather than being parallel to the floor; both legs mounted on the body support are foldable at an angle of 90°; and, in particular, a length of the leg at the front of the bottom side may be 30 cm or more while a length of the other leg at the rear of the bottom side may be 15 cm or less.

In order to prevent the human body from sliding down along the inclined support, and in order to suitably set up and use the body support to suit a height, in particular, a sitting height of the user, the body support of the present invention may further include a pelvis support saddle with a position control function, wherein the saddle is configured in an engaging form enabling position control and fixation of the saddle, and stands up and is foldable at an angle of 90° on a rear part of the top side of the body support by a hinge structure. Further, the front part of the body support as a face seating part may be a fork-like support including two protrusions in the form of a food-putting fork or claws wherein these protrusions are protruded in right and left directions, and wherein a plurality of bolt holes, that is, coupling holes, is formed on the fork-like support in order to easily and conveniently couple and secure different types of face masks thereto.

Advantageous Effects

The body support for reading fabricated according to the present invention may be used by suitably adjusting a position of the saddle to suit a height, that is, a sitting height of any user regardless of age and gender and securing the same. Further, the face mask may be desirably selected by the user according to a face size and/or preference, and then, may be easily coupled to the front part of the body support. Because of the above specific functions, even when reading a book and/or using a mobile device or notebook computer, etc., in a prone position by using the body support for a long time, effects of improving learning performance without body fatigue may be obtained.

Further, the body support of the present invention may prevent a cervical disc problem or vertebral disease often caused by an inconvenient reading manner due to poor posture of youths and may have an advantage of being used as a medical assistance instrument or healthy learning equipment for maintenance of vertebral health in a broad range of applications.

Further, according to personal preference of the user, any individual and unique face mask (for example, a typical face guard for baseball catchers that softly supports the entire face including the forehead, cheekbones, etc., glasses mask, band mask made of a soft elastic material, or the like) may be coupled for use on the face seating part formed at the front of the body support by interconnection using bolts, thereby achieving specific advantages.

BEST MODE

Hereinafter, preferred embodiments of the present invention will be more concretely described with reference to the accompanying drawings.

Figure 1A:
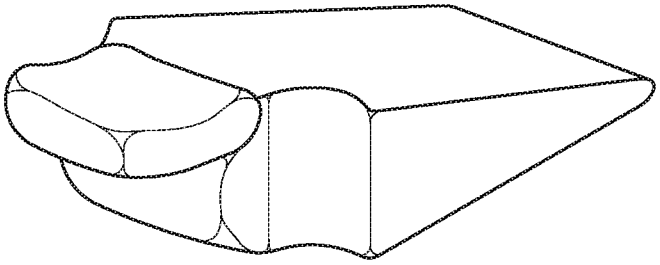
FIG. 1 illustrates perspective views of an existing upper body support designed in the art.
Figure 1B:
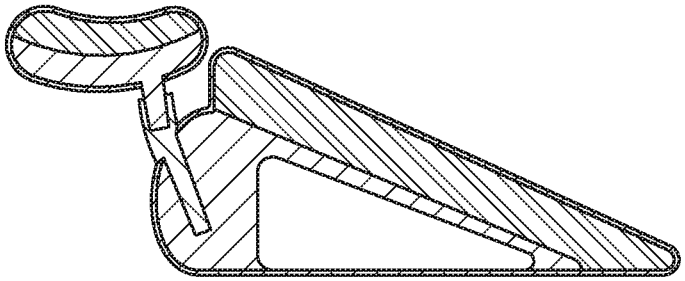
Figure 1C:
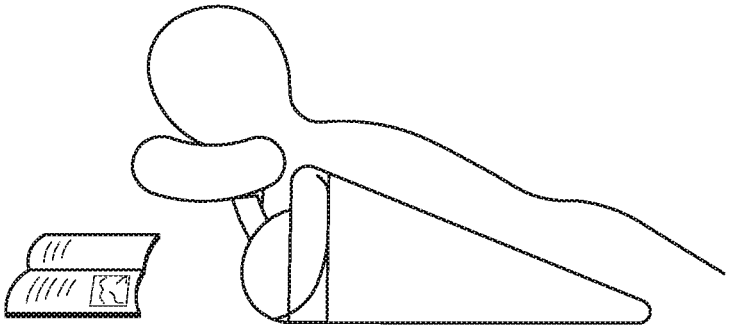
Figure 2A:
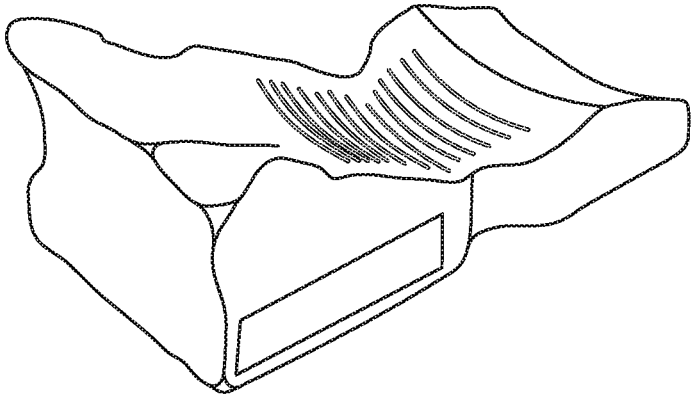
FIG. 2 illustrates perspective views of an existing support for reading in a prone position designed in the art.
Figure 2B:
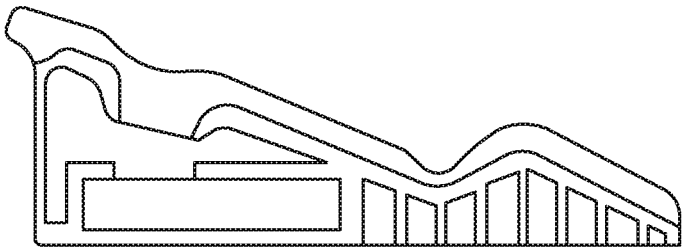
Figure 2C:
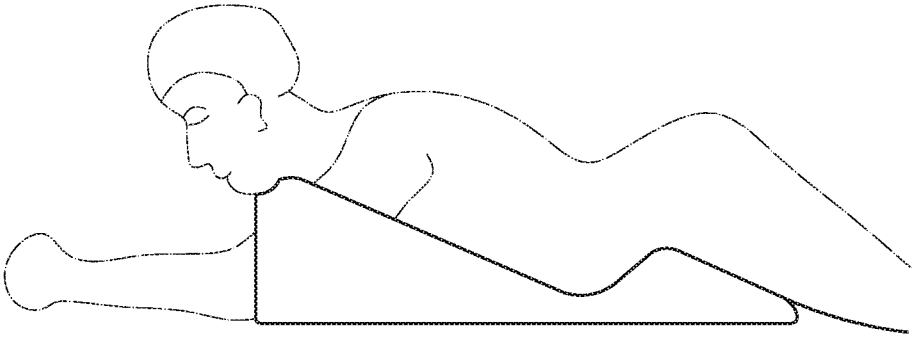
Figure 6:
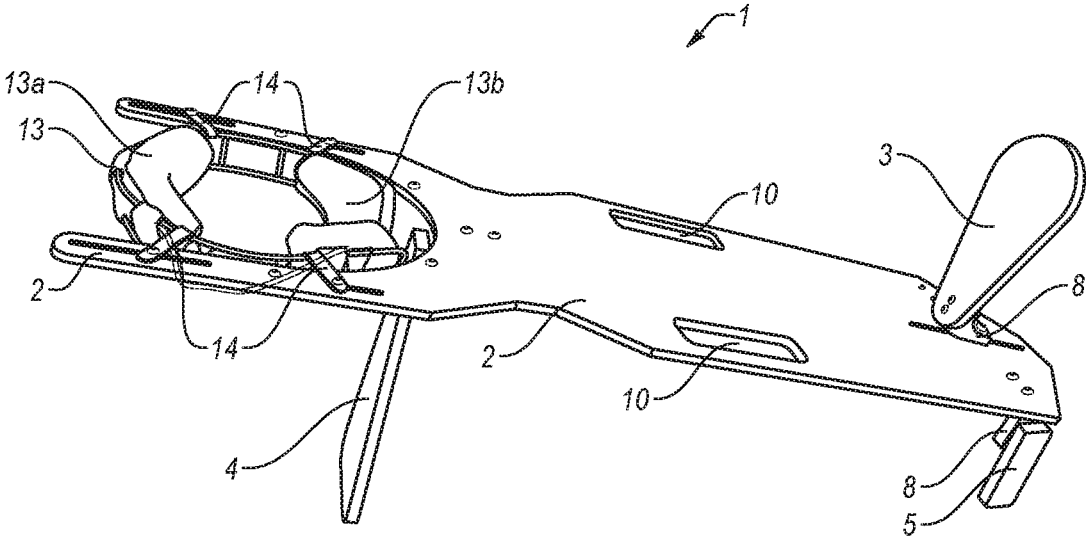
FIG. 6 illustrates a perspective view of a body support made of plastic materials, which was fabricated according to the present invention.

First, FIGS. 1 and 2 are perspective views illustrating an existing upper body support and an existing body support for reading in a prone position designed in the art, respectively. FIG. 6 is a perspective view illustrating the body support fabricated according to the present invention. In general, a surfboard in a plane form is used to ride waves in a prone state by a beginner on the surface of the sea, and may be considered as a support to safely support the human body above the surface of the sea. As such, a main body 2 of the support consisting of a flat board able to support the human body in a prone state may be divided into a face support member A, an upper body support member B and a pelvis support member C.

Figure 8:
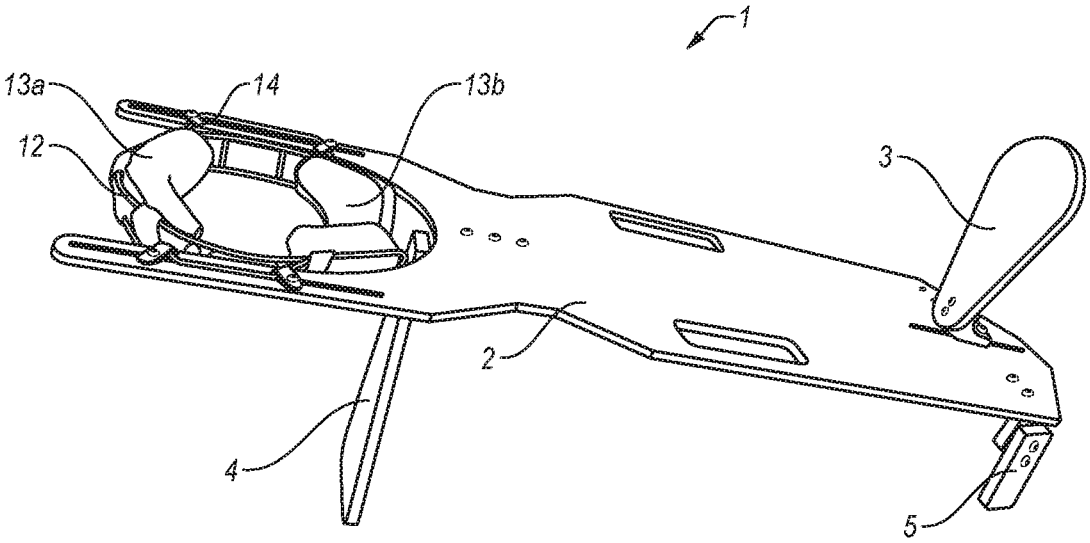
FIG. 8 illustrates a perspective view of a body support made of hardwood materials, which was fabricated according to the present invention.
Figure 9:
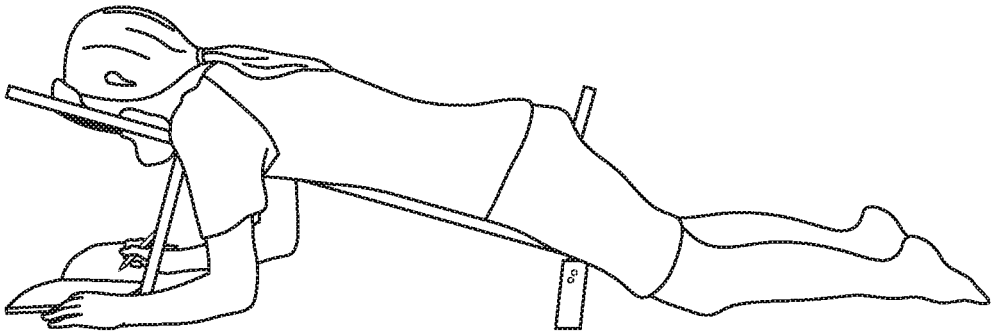
FIG. 9 is a side view photograph showing use of the body support fabricated according to the present invention.
Figure 10:
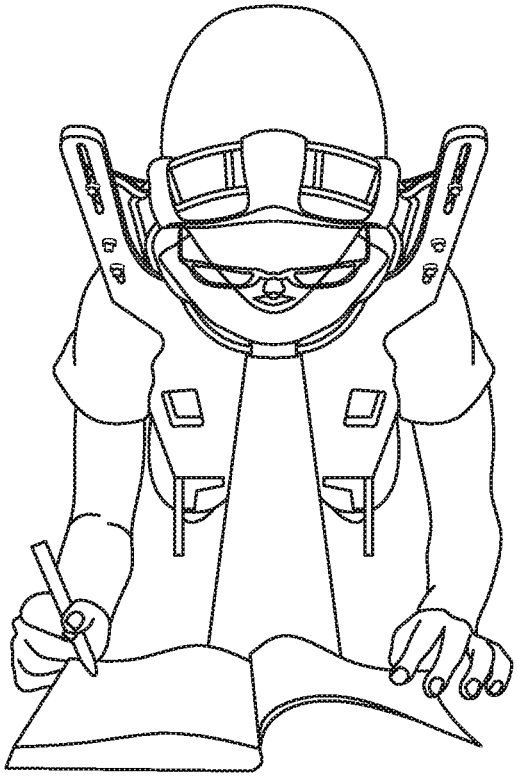
FIG. 10 is a front view photograph showing use of the body support fabricated according to the present invention.
Figure 11:
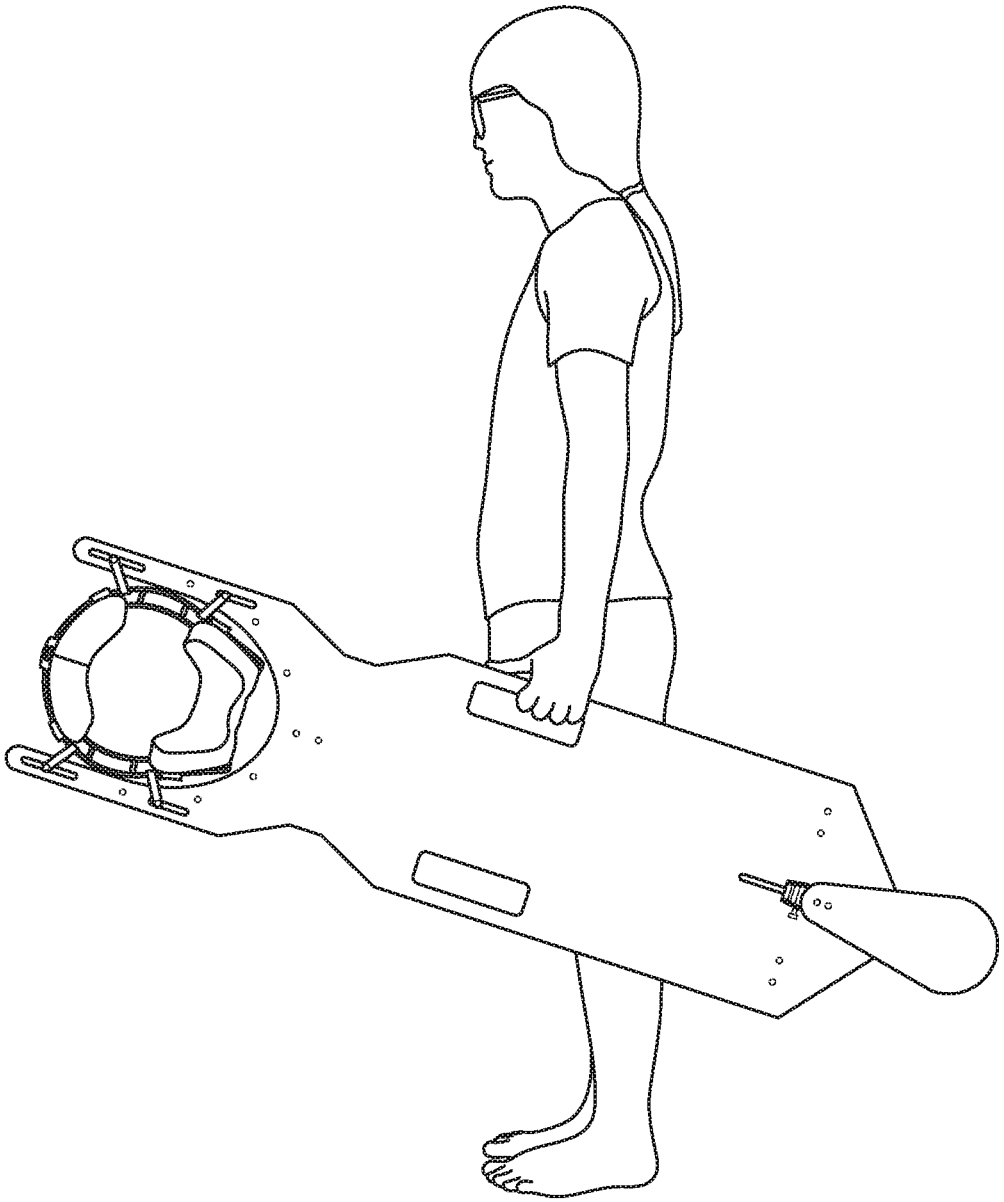
FIG. 11 illustrates an example of a portable function of the body support fabricated according to the present invention.

In particular, the face support member A positioned at the front of the main body 2 may include a protrusion configured in a fork form or such a form that the person should raise both arms over their head in order to couple a mask inside the center of the face support member A, wherein a plurality of bolt holes 6 is bored through the main body 2. Referring to FIGS. 6, 8 and 10, the face mask for protecting and supporting the face may be mounted on the front part of the body support 1 by suspending a mini-belt 14 having bolt holes bored therein on a frame of a mask 12 and then screwing bolts and nuts into bolt holes 6 in the face support member A to couple the mask thereto.

Figure 5:
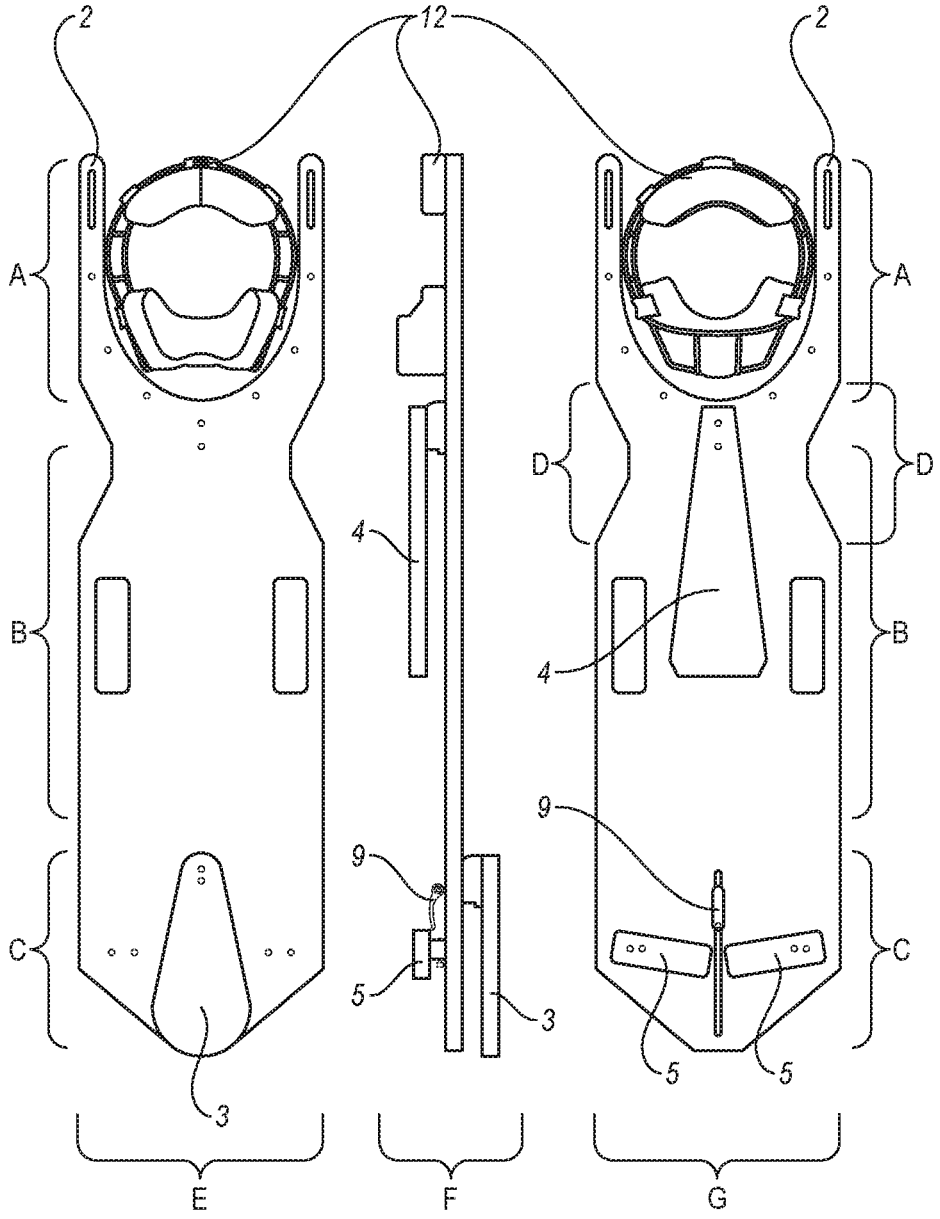
FIG. 5 illustrates an assembly view of components for a body support fabricated according to the present invention.
Figure 7:
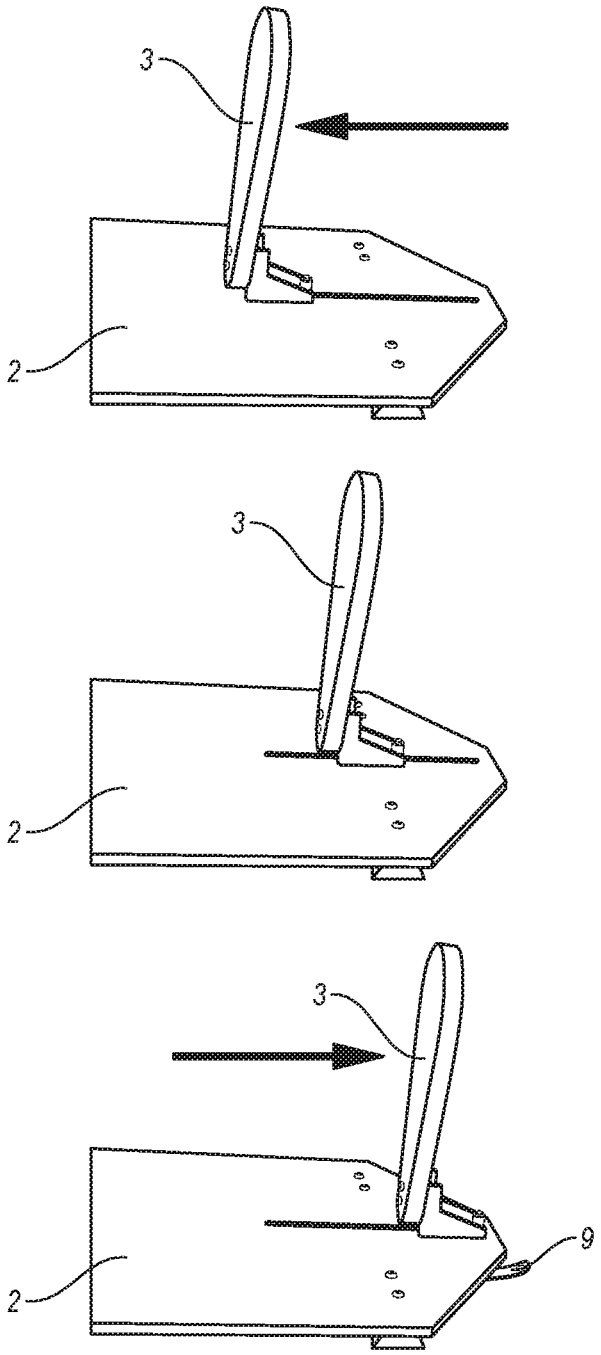
FIG. 7 illustrates examples of adjusting a position of the saddle part of the body support which was fabricated according to the present invention.

Further, a pelvis support saddle 3 is coupled to the main body 2 in the center of the top face of the pelvis support member C positioned at the rear of the main body 2. In this regard, coupling is executed using a leg hinge 8, which is a normal furniture hinge configured to be foldable and unfoldable at an angle of 90°, wherein a safety pin is attached to the leg hinge and functions to unfold the leg and fold again the unfolded leg when pushing the safety pin. For this purpose, a typical leg hinge 8 having bolt holes bored in right and left directions is used. Referring to FIG. 5 and FIG. 7, a part of the leg hinge 8 is fixed to the pelvis support saddle 3 using bolts while the other part is attached to the same by screwing a one-touch QR lever type bolt 9 into a bolt hole 11 for saddle coupling. Therefore, as shown in FIG. 7, a position of the saddle can be adjusted within a space of the bolt hole 11 for saddle coupling in the main body 2 by unlocking the QR lever 9. For reference, the one-touch QR lever 9 may be any typical one generally used in diverse applications, which typically functions to tighten or relax a bicycle saddle in order to change a height of the saddle, and therefore, a detailed description of the same as well as the leg hinge 8 provided with a safety pin will be omitted along with detailed drawings.

Next, at least three support legs are mounted on the bottom side of the main body 2 by using the leg hinge 8 having a safety pin attached thereto, resulting in a portable table shape. In this case, the support legs are folded and unfolded at an angle of 90° along with the pelvis support saddle 3 mounted on the top face of the main body 2. The support legs may be positioned on the front and the rear parts, separately, wherein a front long leg 4 having a length of about 30 cm is mounted on the front part while two rear short legs 5 having a length of about 15 cm are mounted on the rear part. Due to a difference in lengths between both the front leg and the rear legs, when all of the support legs mounted on the main body 2 are viewed in unfolded state from the side, an oblique structure is formed instead of a structure horizontal to the ground. That is, the front part A of the body support has a higher slope angle than that of the rear part C. In the main body 2 having a configuration of the front part A standing up higher than the rear part B, suppose that the most preferable length of the front leg 4 is about 30 cm or more, the length of the rear legs is preferably ½ time or less the length of the front leg, that is, 15 cm or less. However, if required, the rear leg may be omitted in consideration of a size of the main body without any problem in the configuration of the body support. In other words, the presence of a rear leg may have relation to establishing a distance between the ground and a book to read, which is obtained due to a difference in slope angles to the ground, wherein the slope angle is established by a difference in lengths of the front and rear legs.

Hereinafter, the configuration of the body support according to the present invention will be more concretely described with reference to FIGS. 4 and 5.

Figure 3:
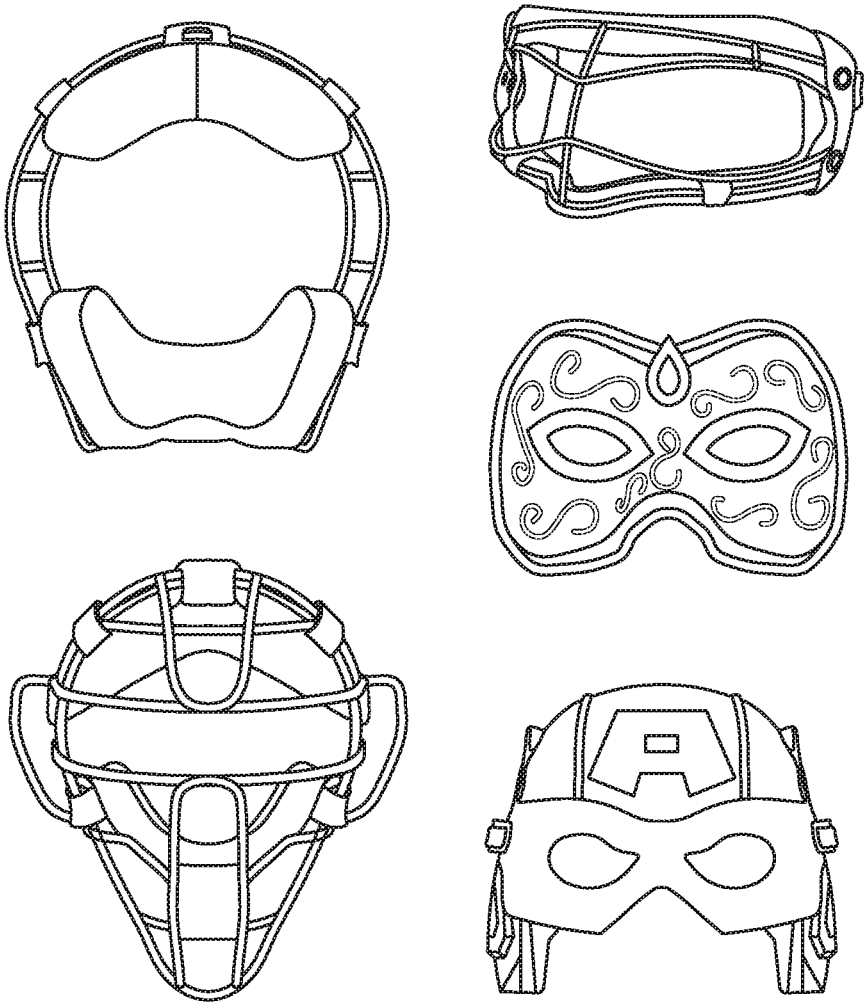
FIG. 3 shows photographs of different face masks for face protection and face support.
Figure 4:
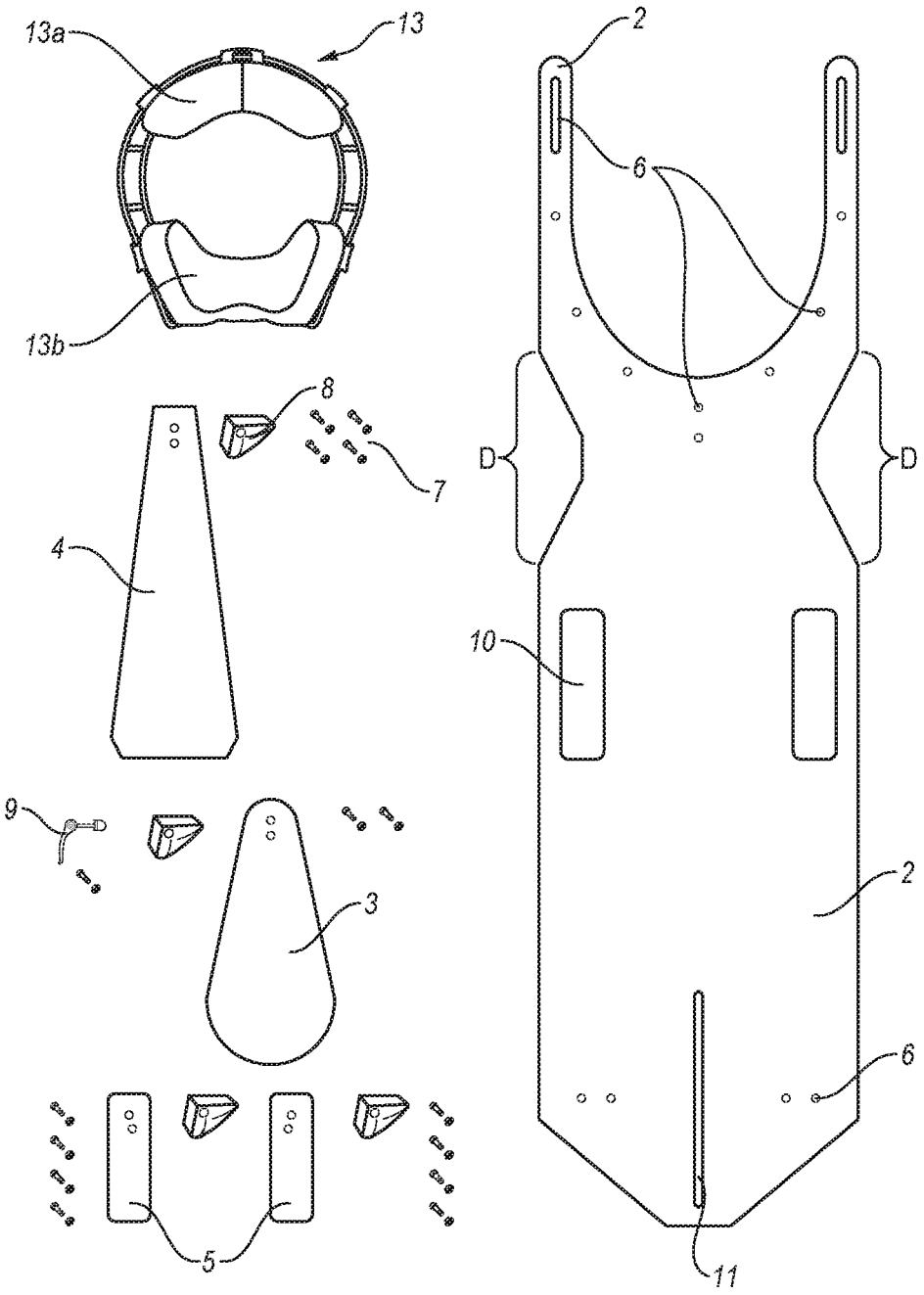
FIG. 4 illustrates an exploded view of components for a body support fabricated according to the present invention.

First, FIG. 4 illustrates an exploded view of individual components of the body support fabricated according to the present invention, while FIG. 5 illustrates an assembly view of exploded components which are combined using bolts and hinges. More particularly, FIG. 5 illustrates the main body 2 of the body support 1, wherein a top face E, a left side F and a bottom face G have rotated right by 90°. On the other hand, FIG. 6 is a perspective view of the body support wherein all of the front and rear legs mounted on the main body 2 as well as the pelvis support saddle have been unfolded and erected by pushing the safety pin. Further, the mask 12 coupled to the face support member A by the mini-belt 14 is typically a tool used for hiding or protecting the face and may include, for example, a camouflage mask to hide the face of a user from others, a mask for safely protecting the face from flying balls such as a face guard for baseball catchers, a glasses style mask configured for security of sight without discomfort while softly supporting the forehead and cheekbones such as diver's goggles, other masks including masks in connection with masquerade costumes, Batman mask, Korean masks, or the like, as shown in FIG. 3. That is, such masks made of rigid and/or soft materials as described above may all be called masks. A face contact part inside the mask includes a forehead contact part 13*a* made of a soft material and a chin contact part 13*b* made of an elastic material.

The body support of the present invention may conveniently and horizontally support the whole face using the mask as described above. The mask 12 may be coupled to the body support by suspending the mini-belt 14, which has bolt holes on right and left sides thereof, on an edge of the mask 12 and screwing bolts into the bolt holes 6 of the face support member A. Optionally, the mask may be bound to the face support member using a strap or may be coupled to the same by a common spring-type key and keychain. Such particular couplings and illustration thereof are considered as commonly used methods and thus detailed description of the same will be omitted.

Accordingly, diverse kinds of masks 12 coupled as described above may be desirably selected according to a size of the face and/or personal preference, and may be directly replaced with another one. Further, considering that the user has a different height, in particular, a different sitting height, the body support of the present invention may have such a configuration that a position of the saddle 3 of the body support is properly adjusted to suit the height of the user so as to prevent the body of the user from sliding down the main body 2 along the inclined support due to gravity, thereby being conveniently used. For instance, supposing that a sitting height of the user is 85 cm, adjusting a position of the pelvis support saddle 3 to establish a distance of 85 cm from an end of the forehead contact part 13*a*, which corresponds to a top end of the mask 12 set on the body support 1, to a beginning part of the pelvis support 3 and then safely securing the same with a QR lever 9, may allow the body support 1 to be under optimum conditions for use by a person having a sitting height of 85 cm. For a student having a sitting height of 77 cm, such a distance of 77 cm as described above, that is, from an end of the forehead contact part 13*a*, which corresponds to a top end of the mask 12, to a beginning part of the pelvis support saddle 3 could be established by adjusting a position of the pelvis support saddle 3.

As described above, a user may lie on the fabricated body support 1 in a prone position such that the body including the face, neck, chest, pelvis and knees are supported by the support and can read a book opened on the floor in front of the support and/or use a smartphone or a notebook computer for a long time. Further, the body support of the present invention may have an advantage of guaranteeing desired metal strength to concentrate on reading without body fatigue and/or pain over the entire body including the neck, despite reading books while keeping the prone position for a long time.

DESCRIPTION OF SYMBOLS (1) Body support
(2) Main body of support
(A) Face support member
(B) Upper body (chest and abdomen) support member
(C) Pelvis support member
(D) Armpit contact part
(E) Top face of the support
(F) Left side of the support
(G) Bottom face of the support
(3) Pelvis support saddle
(4) Front support leg
(5) Rear support leg
(6) Bolt hole
(7) Bolt and nut
(8) Leg hinge provided with safety pin
(9) One-touch QR lever
(10) Handle hole
(11) Bolt hole for saddle coupling
(12) Mask
(13) Catcher's mask
(13*a*) Contact part of forehead
(13*b*) Contact part of chin
(14) Mini-belt

The invention claimed is:

1. A portable support provided with foldable support legs to be folded and unfolded for supporting, if necessary, such as a portable temporary bed or foldable table, which includes a mask and a saddle, and has an oblique construction, more particularly, comprising:

a support including support legs mounted on the bottom of the support, wherein a front support leg has a length of 30 cm or more while a rear support leg has a length of 15 cm or less, and thus, when unfolding all of the legs to erect the support on flat ground, a front part of the support is set up at a higher slope angle than that of a rear part of the support, and wherein the inclined support for supporting a whole body is divided into three parts such as a face support member, an upper body part member and a pelvis support member;

a face supporting mask coupled to the face support member having a higher slope angle by using a mini-belt and bolts; and a pelvis supporting saddle coupled to the pelvis support member having a lower slope angle, on which the pelvis is sup-ported, by using a hinge and bolts, so that, when the support is used for reading while supporting the whole body in a prone state, the support enables reading while conveniently supporting the whole body including the face, the upper body and the pelvis, and preventing the body from sliding down along the inclined part of the support, wherein the pelvis support saddle is fabricated in a foldable form and the pelvis support saddle is coupled to the pelvis support member corresponding to the rear part of the support with a leg hinge and a one-touch quick release lever such that the pelvis support saddle is folded and unfolded within the range of an angle of 90° relative to the pelvis support member, and wherein a bolt hole for coupling the pelvis support member is formed in the form of a long and narrow slit from the front to the rear of the support so that the pelvis support saddle can be shifted in front and rear directions within a space of the bolt hole using the one-touch quick release lever.

* * * * *